US007922532B2

(12) United States Patent
Su et al.

(10) Patent No.: US 7,922,532 B2
(45) Date of Patent: Apr. 12, 2011

(54) CABLE CONNECTOR HAVING IMPROVED GROUNDING MEANS

(75) Inventors: Ping-Sheng Su, Tu-Cheng (TW); Jun Chen, Kunshan (CN); Feng-Jun Qi, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/783,580

(22) Filed: May 20, 2010

(65) Prior Publication Data

US 2010/0297878 A1 Nov. 25, 2010

(30) Foreign Application Priority Data

May 20, 2009 (CN) ..... 2009 2 0303370

(51) Int. Cl.
*H01R 13/648* (2006.01)

(52) U.S. Cl. ..... 439/607.23; 439/607.34; 439/607.41

(58) Field of Classification Search ..... 439/607.01–607.17, 108, 604, 439/493, 626, 660, 607.23, 607.34, 607.41
See application file for complete search history.

(56) References Cited

U.S. PATENT DOCUMENTS

| | | | | |
|---|---|---|---|---|
| 6,273,757 | B1 * | 8/2001 | David et al. | 439/607.13 |
| 6,923,666 | B1 * | 8/2005 | Liao | 439/172 |
| 6,939,168 | B2 * | 9/2005 | Oleynick et al. | 439/541.5 |
| 7,422,488 | B1 | 9/2008 | Wu | |
| 2005/0153588 | A1 * | 7/2005 | Liao | 439/172 |
| 2006/0134962 | A1 * | 6/2006 | Yeh | 439/352 |
| 2006/0141865 | A1 * | 6/2006 | Su et al. | 439/607 |
| 2006/0148300 | A1 * | 7/2006 | Huang et al. | 439/353 |
| 2006/0155914 | A1 * | 7/2006 | Jobs et al. | 711/100 |

* cited by examiner

*Primary Examiner* — Neil Abrams
*Assistant Examiner* — Phuongchi T Nguyen
(74) *Attorney, Agent, or Firm* — Wei Te Chung; Andrew C. Cheng; Ming Chieh Chang

(57) ABSTRACT

A cable connector (100) for soldering at a predetermined position with a cable (4) including a number of first wires (41) each having a conductor (412). The cable connector includes an insulative housing (1), a number of contact terminals (2) mounted in the insulative housing, and a pair of shielding shells (3) assembled to the insulative housing. Each contact terminal has a contact portion (21) and a tail portion (22). Each shielding shell is formed with a grounding portion (35) extending toward the tail portion of one of the contact terminals. The grounding portion, the tail portion of one of the contact terminals arrive at the predetermined position and are soldered with the conductor of an associated first wire at the predetermined position.

14 Claims, 5 Drawing Sheets

CABLE CONNECTOR HAVING IMPROVED GROUNDING MEANS

BACKGROUND OF THE INVENTION

1. Field of the Invention

The present invention relates to a connector, and more particularly to a cable connector connectable with a cable and having a shielding shell provided with a grounding portion soldered with the cable for grounding.

2. Description of Related Art

U.S. Pat. No. 7,422,488 issued to Wu on Sep. 9, 2008 discloses a cable connector adapted for connecting with a cable having a plurality of conductive wires. The cable connector comprises an insulative housing and a plurality of first and second contacts retained in the insulative housing. The second contacts include a grounding contact and a number of differential signal contacts. The differential signal contact has one end connected with the first contact, and another end soldered with the conductive wire of the cable. The grounding contact has one end soldered with the conductive wire of the cable and another end for grounding. The insulative housing has a tongue portion defining a plurality of first recesses for receiving the differential signal contacts and a second recess for receiving grounding contact.

It is complicated to provide the grounding contact for grounding. Additionally, the second recess would occupy a certain space. It is a hard work to define the second recess beside the four first recesses on the tongue portion which should be designed into a standard dimension.

Hence, a cable connector having an improved grounding means is highly desired.

SUMMARY OF THE INVENTION

Accordingly, an object of the present invention is to provide a cable connector connectable with a cable and including a shielding shell provided with a grounding portion soldered with the cable for grounding.

In order to achieve the object set forth, a cable connector for soldering at a predetermined position with a cable including a number of first wires each having a conductor. The cable connector includes an insulative housing, a number of contact terminals mounted in the insulative housing, and a pair of shielding shells assembled to the insulative housing. Each contact terminal has a contact portion and a tail portion. Each shielding shell is formed with a grounding portion extending toward the tail portion of one of the contact terminals. The grounding portion, the tail portion of one of the contact terminals arrive at the predetermined position and are soldered with the conductor of an associated first wire at the predetermined position.

The shielding shell has a grounding portion extending therefrom and soldered with the contact terminal and the cable for grounding. It doesn't need to provide any grounding terminals or other extra grounding members. The cable connector has a simple configuration and it is easy to perform grounding.

Other objects, advantages and novel features of the invention will become more apparent from the following detailed description when taken in conjunction with the accompanying drawings.

DETAILED DESCRIPTION OF THE PREFERRED EMBODIMENT

Figure 1:
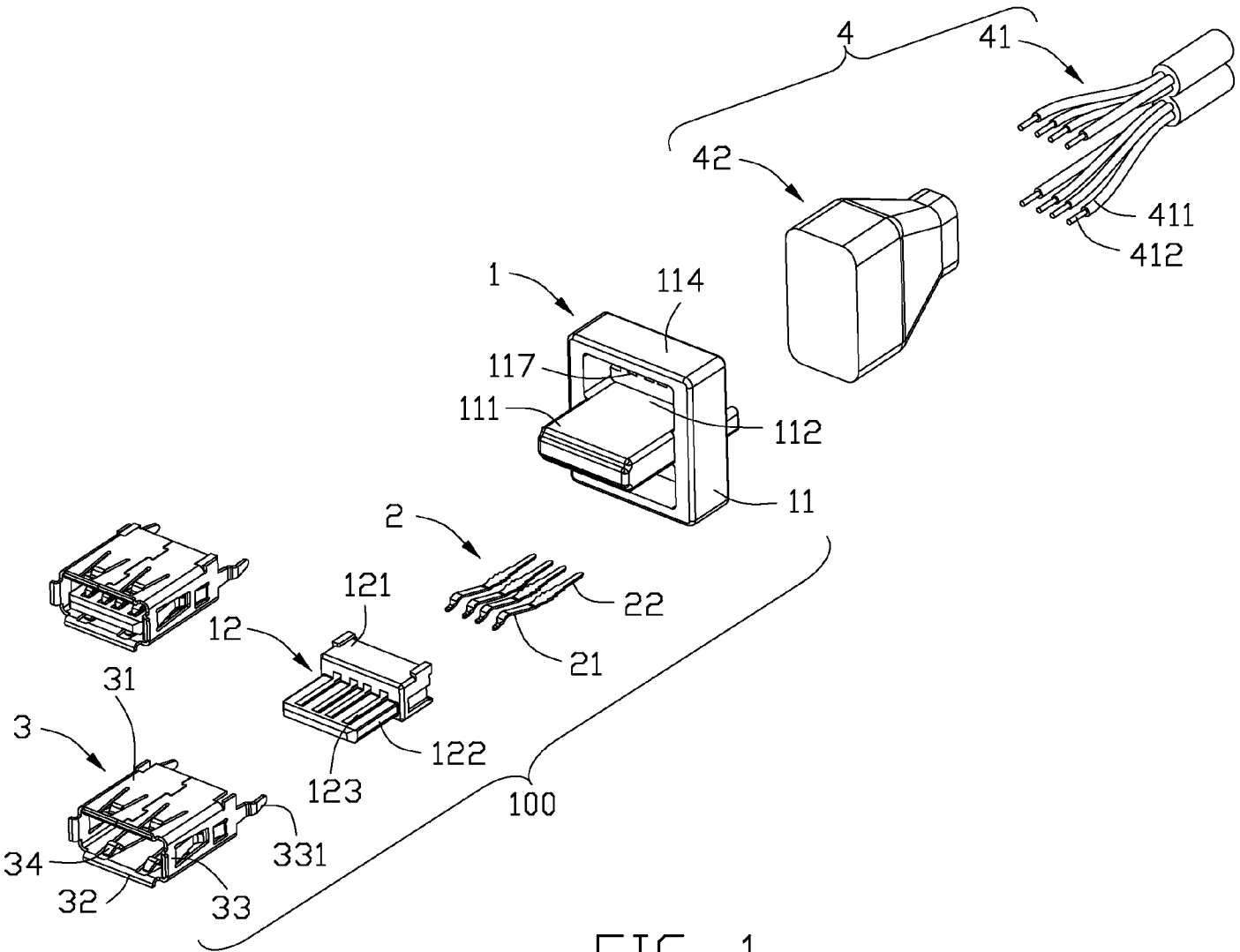
FIG. 1 is an exploded perspective view showing a cable connector and a cable.

Reference will now be made in detail to the preferred embodiment of the present invention. Referring to FIG. 1, a cable connector 100 is adapted for connecting with a cable 4. The cable connector 100 is a USB (Universal Serial Bus) connector or other types of connector. The cable connector 100 comprises an insulative hosing 1, a plurality of contact terminals 2 inserted in the insulative housing 1 and a pair of shielding shells 3 attached to the insulative housing 1.

Referring to FIGS. 1-5, the insulative housing 1 comprises a first housing 11 and a pair of second housings 12. The first housing 11 comprises a body portion 114 having a rear wall 115, and a protruding portion 111 protruding beyond the body portion 114. The body portion 114 has a pair of inserting recesses 112 defined at opposite sides of the protruding portion 111. The rear wall 115 of the body portion 114 defines a plurality of first slots 116 and second slots 117 communicating with the inserting recesses 112.

Each second housing 12 comprises a body portion 121 and a tongue portion 122 protruding forwardly from the body portion 121. The second housing 12 defines a plurality of passageways 123.

Each contact terminal 2 comprises a contact portion 21 and a tail portion 22.

Each shielding shell 3 comprises a top wall 31, a bottom wall 32, a pair of side walls 33 and a plurality of resilient beams 34. Each side wall 33 of the shielding shell 3 has a resisting portion 331 extending rearwardly from a rear edge thereof. The bottom wall 32 of the shielding shell 3 is provided with a grounding portion 35.

Figure 2:
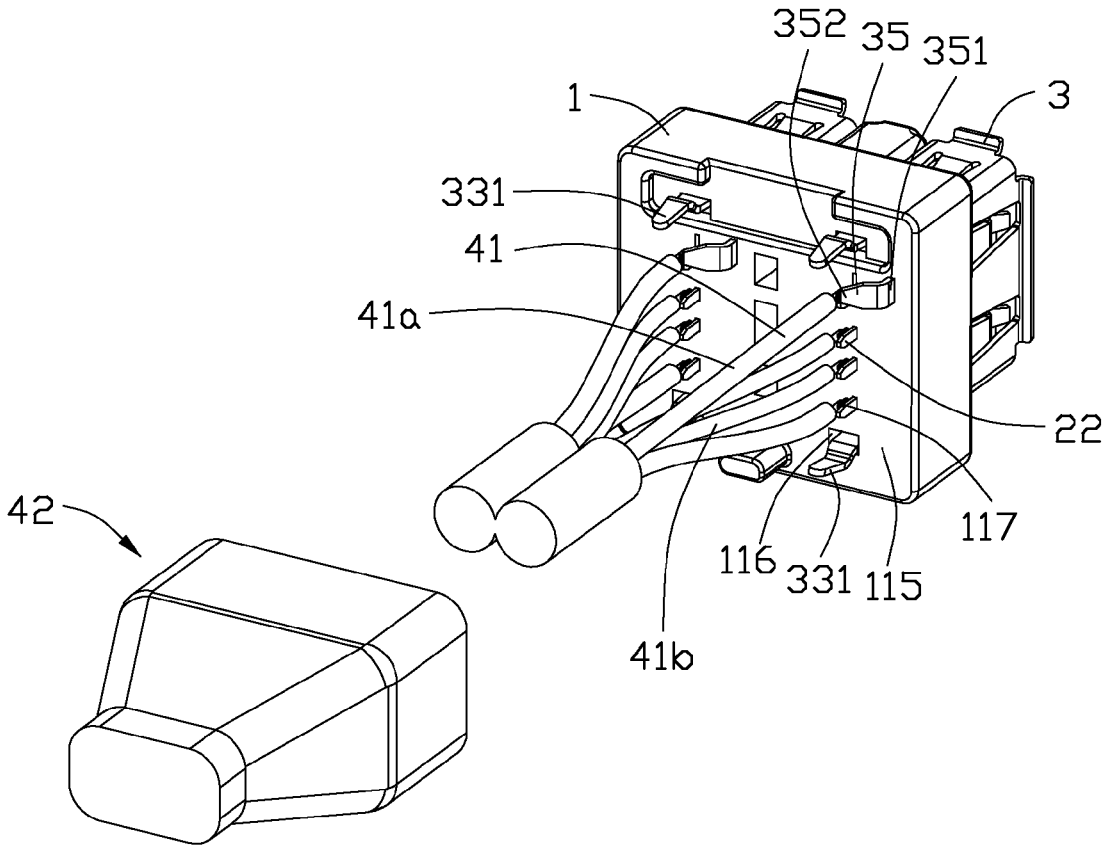
FIG. 2 is a perspective view showing the cable connector and the cable, with a cover of the cable separated from the cable connector.
Figure 3:
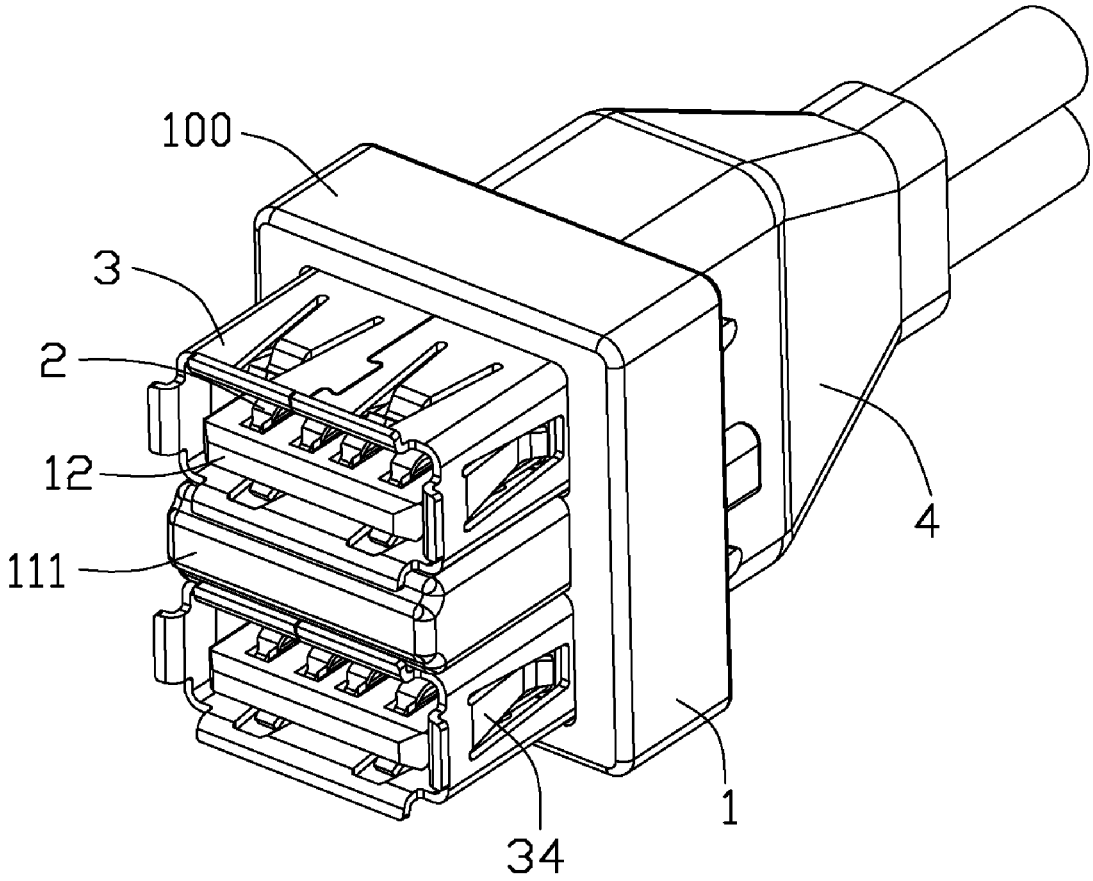
FIG. 3 is an assembled perspective view showing the cable connector and the cable.
Figure 4:
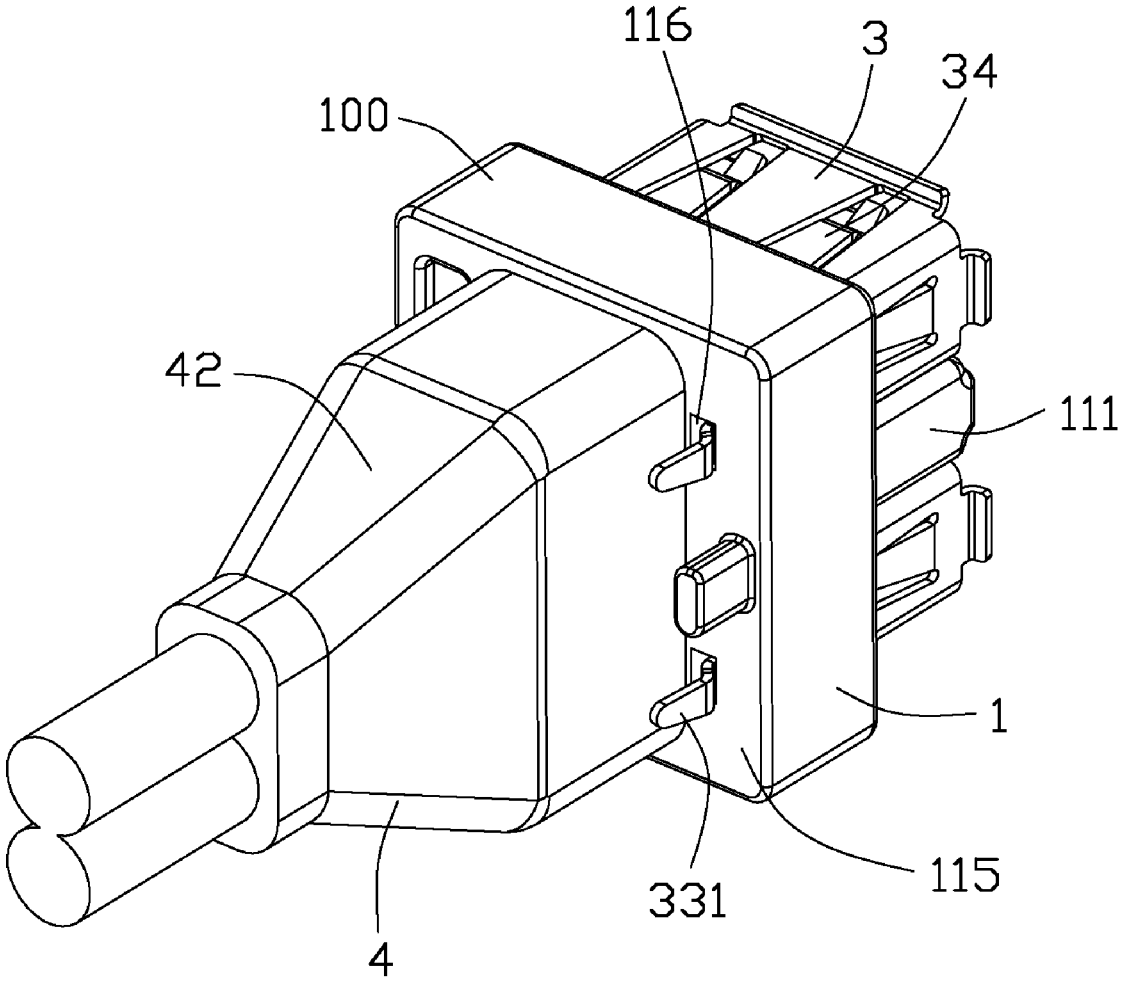
FIG. 4 is a view similar to FIG. 3, taken from another aspect.

Referring to FIG. 2, the cable 4 includes a plurality of wires 41 categorized with a plurality of first wires 41*a* and a plurality of second wires 41*b*, and a cover 42 shrouding the wires 41. Each wire 41 comprises an outer jacket 411 and a conductor 412 partially exposed from the outer jacket 411. The first wire 41*a* is connected to cathode of power. The second wire 41*b* is connected to anode of power and signal source.

Referring to FIGS. 1-4, in assembling of the cable connector 100, the plurality of contact terminals 2 are inserted in the passageways 123 of the second housing 12. The pair of second housings 12 are inserted in the pair of inserting recesses 112, with the tail portions 22 of the contact terminals 2 inserting outwardly from the second slots 117. The pair of shielding shells 3 are respectively mounted on the pair of second housings 12, with the resisting portions 331 inserting through the rear wall 115 of the first housing 11. Each shielding shell 3 is formed with a connecting portion 351 extending from a rear edge of the bottom wall 32 and extending through the first slot 116. When the connecting portion 351 is inserted through the first slot 116, the grounding portion 35 has a free end bent from the connecting portion 351 toward the tail portion 22 of the contact terminal 2 to form a bending portion 352. The direction to which the resisting portion 331 faces is perpendicular to the direction to which the grounding portion 35 faces.

Figure 5:
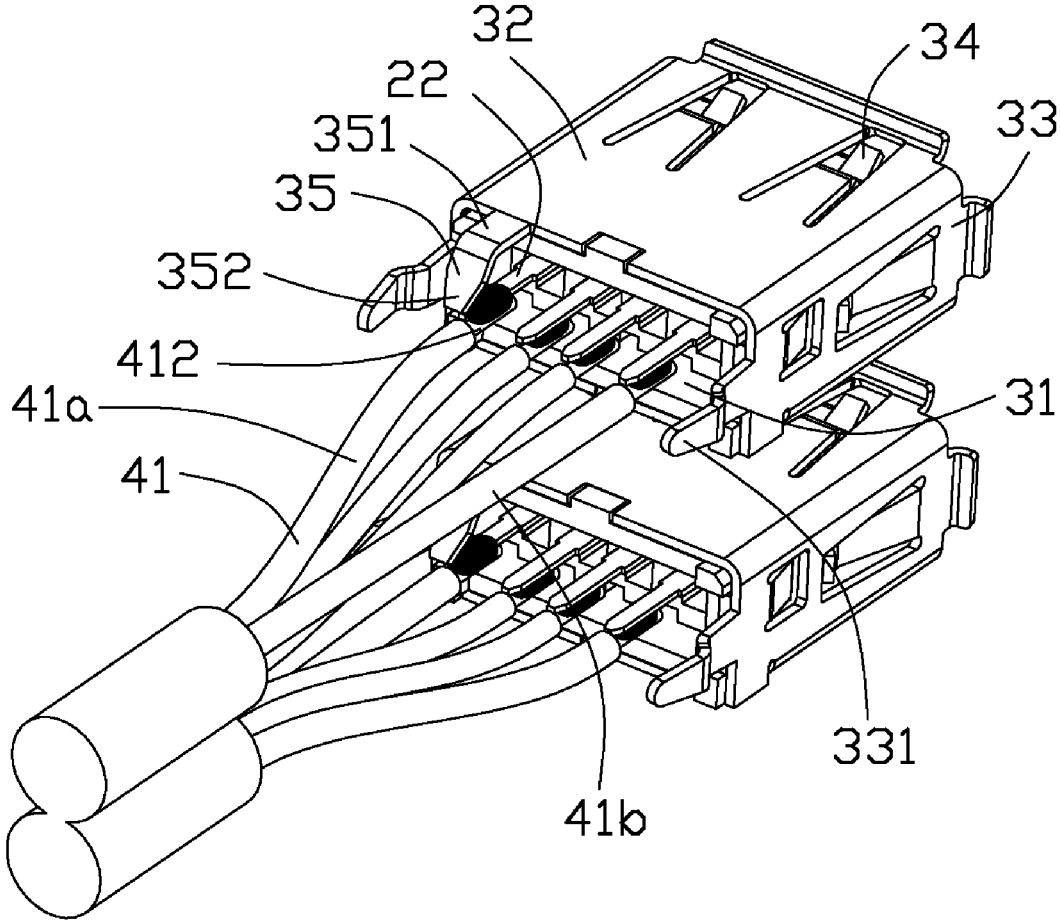
FIG. 5 is a view of the cable connector and the cable, with the first housing and the cover being removed.

Referring to FIGS. 2 and 5, when the cable 4 is soldered onto the cable connector 100, the conductor 412 of the first wire 41*a*, the tail portion 22 of the associated contact terminal 2 and the bending portion 352 of the grounding portion 35 arrive at a predetermined position and are soldered as a whole at the predetermined position. The conductor 412 of the second wire 41*b* and the tail portions 22 of the associated contact terminal 2 are soldered as a whole. The cover 42 is assembled to the insulative housing 1 and enclose the wires 41, with the resisting portions 331 resisting against the cover 42 of the cable 4.

The shielding shell 3 has a grounding portion 35 extending from the rear edge thereof. The tail portion 22 of the contact terminal 2, the conductor 412 of the cable 4 and the grounding portion 35 of the shielding shell 3 are soldered as a whole for transmitting signal and for grounding simultaneously. It doesn't need to provide any extra grounding members to realize grounding easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector for soldering at a predetermined position with a cable comprising a plurality of first wires each having a conductor, comprising: an insulative housing;

the insulative housing comprises a first housing and a pair of second housings; the first housing comprises a body portion having a rear wall, and a protruding portion protruding beyond the body portion; the body portion has a pair of inserting recesses defined at opposite sides of the protruding portion; the rear wall of the body portion defines a plurality of first slots and second slots communicating with the inserting recesses; the pair of second housing are inserted in the pair of the inserting recesses; each second housing comprises a body portion and a tongue portion protruding forwardly from the body portion; the second housing defines a plurality of passageways;

a plurality of contact terminals are inserted in the passageways and mounted in the insulative housing, each contact terminal having a contact portion and a tail portion;

at least one shielding shell assembled to the insulative housing and formed with a grounding portion extending toward the tail portion of one of the contact terminals, said grounding portion and said tail portion of the one contact terminal being soldered together with said conductor of an associated first wire;

the cable includes a plurality of wires categorized with a plurality of first wires and a plurality of second wires, and a cover shrouding the wires; each wire comprises an outer jacket and a conductor partially exposed from the outer jacket; the first wire is connected to cathode of power; the second wire is connected to anode of power and signal source;

a pair of shielding shells are respectively mounted on the pair of second housings, with the resisting portions inserting through the rear wall of the first housing; each shielding shell is formed with a connecting portion extending from a rear edge of the bottom wall and extending through the first slot; when the connecting portion is inserted through the first slot, the grounding portion has a flee end bent from the connecting portion toward the tail portion of the contact terminal to form a bending portion.

2. The cable connector as claimed in claim 1, wherein there are two grounding portions each formed on one of the shielding shells.

3. The cable connector as claimed in claim 2, wherein; the grounding portion of the shielding shell are soldered as a whole for transmitting signal and for grounding simultaneously.

4. The cable connector as claimed in claim 3, wherein; the cable connector is a USB (Universal Serial Bus) connector.

5. The cable connector as claimed in claim 4, wherein said first housing is formed with a protruding portion between the pair of inserting recesses, said pair of second housings being located at opposite sides of the protruding portion.

6. The cable connector as claimed in claim 5, wherein; the conductor of the second wire and the tail portions of the associated contact terminal are soldered as a whole.

7. The cable connector as claimed in claim 6, wherein said shielding shell comprises a top wall, a bottom wall and a pair of side walls.

8. The cable connector as claimed in claim 7, wherein said side walls of the shielding shell are formed with a pair of resisting portions for resisting against an outer surface of the cable.

9. The cable connector as claimed in claim 8, wherein said grounding portion of the shielding shell faces toward a direction substantially perpendicular to another direction to which the resisting portion faces.

10. A cable connector for soldering at a predetermined position with a cable comprising a plurality of first wires each having a conductor, comprising: an insulative housing;

the insulative housing comprises a first housing and a pair of second housings; the first housing comprises a body portion having a rear wall, and a protruding portion protruding beyond the body portion; the body portion has a pair of inserting recesses defined at opposite sides of the protruding portion; the rear wall of the body portion defines a plurality of first slots and second slots communicating with the inserting recesses; the pair of second housing are inserted in the pair of the inserting recesses; each second housing comprises a body portion and a tongue portion protruding forwardly from the body portion; the second housing defines a plurality of passageways;

a plurality of contact terminals are inserted in the passageways and mounted in the insulative housing, each contact terminal having a contact portion and a tail portion;

at least one shielding shell assembled to the insulative housing and formed with a grounding portion extending toward the tail portion of one of the contact terminals, said grounding portion and said tail portion of the one contact terminal being soldered together with said conductor of an associated first wire;

the cable includes a plurality of wires categorized with a plurality of first wires and a plurality of second wires, and a cover shrouding the wires; each wire comprises an outer jacket and a conductor partially exposed from the outer jacket; the first wire is connected to cathode of power; the second wire is connected to anode of power and signal source;

a pair of shielding shells are respectively mounted on the pair of second housings, with the resisting portions inserting through the rear wall of the first housing; each shielding shell is formed with a connecting portion extending from a rear edge of the bottom wall and extending through the first slot; when the connecting portion is inserted through the first slot, the grounding portion has a flee end bent from the connecting portion toward the tail portion of the contact terminal to form a bending portion;

said conductor of one of the first wires of the cable, the tail portion of one of the contact terminals and the grounding portion of the shielding shell being soldered together at a predetermined position.

11. The cable assembly as claimed in claim 10, wherein said cable comprising a plurality of second wires each having a conductor, said tail portion of another contact terminal is soldered with said conductor of an associated second wire.

12. The cable assembly as claimed in claim 11, wherein; the cable connector is a USB (Universal Serial Bus) connector.

13. The cable assembly as claimed in claim 11, wherein said cable has a cover enclosing the first and second wires, said shielding shell is formed with a pair of resisting portions resisting against the cover of the cable, said grounding portion of the shielding shell facing toward a direction substantially perpendicular to another direction to which each resisting portion faces.

14. A cable connector assembly comprising:

a first insulative housing;

a second insulative housings located in front of the first housing and equipped with a mating tongue extending forwardly thereof, a plurality of contacts including one signal contact thereof and disposed in the second housings with contacting sections exposed upon the mating tongue and soldering tails exposed rearwardly beyond the first insulative housing;

a metallic shells defining a rectangular frame structure surrounding the second insulative housings;

the metallic shells including at least one grounding leg inwardly bent toward and around the soldering tail of said one signal ground contact; and a plurality of wires soldered to the corresponding soldering tails, respectively, wherein the wire soldered to the tail section of the one signal ground contact is further soldered to the grounding leg of the shell;

said first insulative housing and said second insulative housing are discrete from each other while being assembled together;

said first insulative housing and said second insulative housing are fastened together via said shell;

said shell includes a plurality of resisting portions extending through and beyond the first insulative housing;

said wires and the corresponding soldering tails are enclosed in the cover, and the resisting portions are located outside of the cover and abut against the cover;

a third insulative housing with correspond contacts and shell, is assembled to the first insulative housing;

said first insulative housing defines a protruding portion separating said second insulative housings and the third insulative housing.

* * * * *